US005540603A

United States Patent [19]

Fujiwara

[11] Patent Number: 5,540,603

[45] Date of Patent: Jul. 30, 1996

[54] FEMALE CONTACT

[75] Inventor: Yoshihito Fujiwara, Tokyo, Japan

[73] Assignee: The Whitaker Corporation, Wilmington, Del.

[21] Appl. No.: 399,858

[22] Filed: Mar. 7, 1995

[30] Foreign Application Priority Data

Apr. 21, 1994 [JP] Japan ..... 6-083343

[51] Int. Cl.[6] ..... H01R 11/22

[52] U.S. Cl. ..... 439/851; 439/839; 439/850

[58] Field of Search ..... 439/842–854, 439/861, 862, 839

[56] References Cited

U.S. PATENT DOCUMENTS 4,560,231 12/1985 Shirai ..... 439/851
5,350,321 9/1994 Takenouchi ..... 439/851

FOREIGN PATENT DOCUMENTS 1238755 7/1971 United Kingdom .
1287703 9/1972 United Kingdom .
1309769 3/1973 United Kingdom .
1355778 6/1974 United Kingdom .
2183937 6/1987 United Kingdom .

*Primary Examiner*—David L. Pirlot
*Attorney, Agent, or Firm*—Timothy J. Aberle

[57] ABSTRACT

A female contact 40 having highly precise anti-overstress protrusions 68 which are resistant to deformation caused by excessive external forces. Protrusions 68 that protect a spring-loaded contacting section 60 from overstress are located between a bottom wall 52 and the spring-loaded contacting section 60 which extends backward from a front end of the bottom wall 52. The protrusions 68 are formed by bending a portion inwardly of the side walls 48, 50 between two slits therein. Since these protrusions 68 are V-shaped with both ends fixed at the walls 48 and 50, they are generally not subject to deformation caused by external forces.

8 Claims, 4 Drawing Sheets

FEMALE CONTACT

FIELD OF THE INVENTION

This invention relates to female contacts intended for retaining inserted male contacts.

BACKGROUND OF INVENTION

Female contacts are usually arranged in a male housing. They are comprised of a reception section intended for holding male contacts arranged in a female housing and a crimping section intended for the connection of electric wire by crimping the wire in place. As shown in the FIGS. 8–9, a prior art female contact 10 is formed by bending a conductive flat metal sheet. It has J-shaped contacting members 12 and a spring-loaded contacting tab 14 formed to receive a male contact 20. The spring-loaded contacting tab 14 strongly clamps the male contact 20 against the U-shaped tubular contacting members 12.

The male contact 20 is usually inserted in the female contact 10 parallel to the direction of connection as shown by the arrow 22. However, in some cases, it is inserted at an angle to the spring-loaded contacting tab 14. In such cases, the tip of the male contact 20 exerts a strong force on the spring-loaded contacting tab 14. If the reaction produced by this force exceeds the limit of elasticity of the spring-loaded contacting tab 14, then the tab will undergo plastic deformation. In order to avoid plastic deformation, stopping shoulders 16 formed from the side walls of the contacting members 12 and extending inside are provided as shown in Japanese Patent Publication 83-62564. However, since these stopping shoulders 16 are made in the form of cantilevered elements having a support only at one end, they are subjected to deformation if an excessive force is applied to the spring-loaded contacting tab 14 and thus making the stopping shoulders 16 unsuitable for the anti-overstress function.

As an alternative, as disclosed in Japanese Utility Model Publication 89-38777, a female contact 30 has been offered (FIGS. 10–12) in which a boss 36 is formed from the bottom wall 34 under the spring-loaded tab 32. Due to the configuration of boss 36, it is able to withstand a large amount of stress. However, this alternative requires the use of sheet metal materials that are limited to the materials suitable for excessive forming treatment and therefore materials with a high modulus of elasticity cannot be employed. This makes it impossible to form a spring-loaded contacting tab by bending a metal sheet having a high modulus of elasticity which would be able to strongly hold a male contact. Another disadvantage is that it is very difficult to produce and maintain a precise height of the formed boss when its height is large.

The purpose of this invention is to overcome the disadvantages of the previous mentioned female contacts by offering a new design of a female contact equipped with a protrusion performing functions of overstress protection and with a spring-loaded contacting section which is not subject to deformation under high stress forces. In order to achieve this purpose, the female contact according to this invention comprises a bottom wall extending in the direction of connection, a spring-loaded contacting section extending to the back above the bottom wall from the front end of the bottom wall, side walls rising from the sides of the bottom wall, and a protrusion formed by a portion of the side wall between two parallel cuts preferably parallel to the bottom wall, in at least one of the side walls, which extends between the bottom wall and the spring-loaded contacting section.

SUMMARY OF THE INVENTION

The female contact according to this invention has a protrusion situated between the bottom wall and the spring-loaded contacting section. This protrusion is formed by a wall portion between two parallel cuts in the wall and is V-shaped with two fixed ends at the wall. The protrusion of such a configuration has a high resistance to strong external forces and prevents deformation of the spring-loaded contacting section when a male contact pushes the spring-loaded contacting section downward as it is inserted in the female contact. In addition, the protrusion can prevent the female contact from being deformed by twisting or other undesirable deformations that may occur to the bottom wall under the spring-loaded contacting section.

BRIEF DESCRIPTION OF THE DRAWINGS

An embodiment of the invention will now be described by way of example with reference to the accompanying drawings in which.

DETAILED DESCRIPTION OF THE INVENTION

Figure 1:
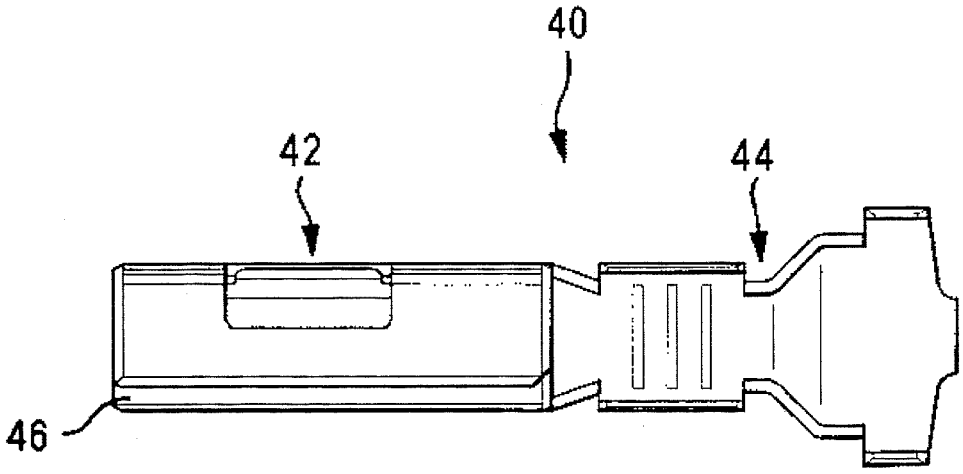
FIG. 1 is a top view of an embodiment of a female contact.
Figure 2:
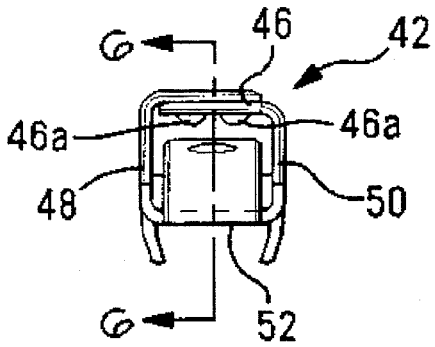
FIG. 2 is a front view of the female contact in FIG. 1.
Figure 6:
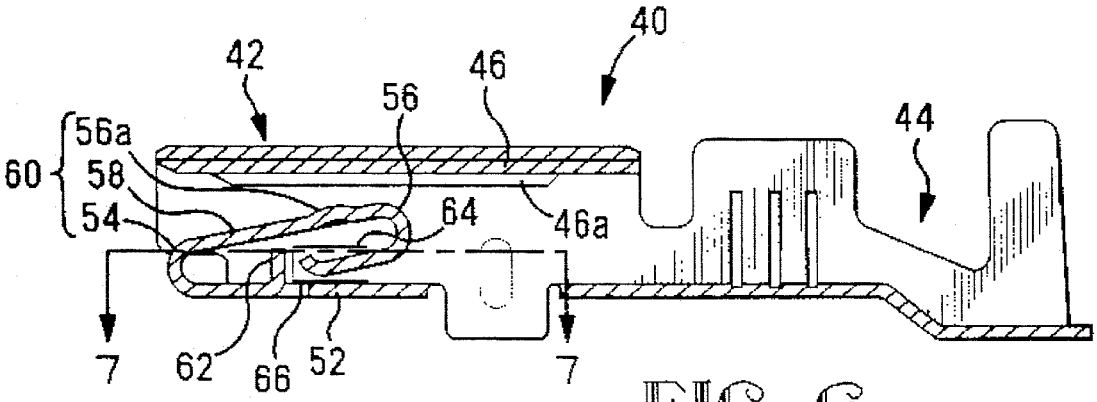
FIG. 6 is a cross-sectional view taken along line 6—6 in FIG. 2.
Figure 7:
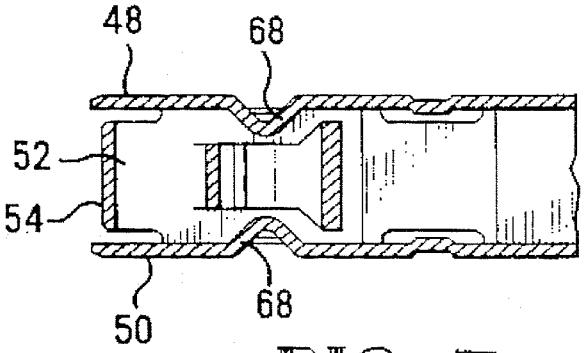
FIG. 7 is a cross-sectional view taken along line 7—7 in FIG. 6.
Figure 8:
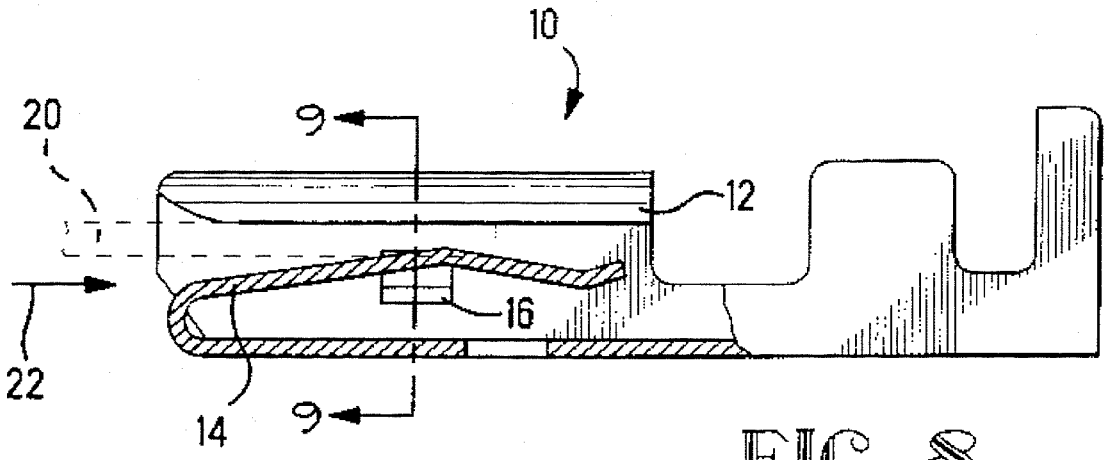
FIG. 8 Prior Art
FIG. 8 is a cross-sectional view of a conventional female contact.
Figure 9:
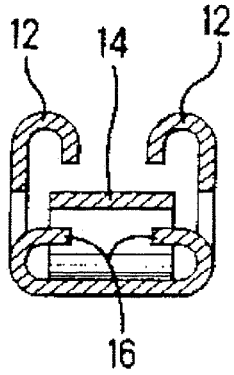
FIG. 9 Prior Art
FIG. 9 is a cross-sectional view taken along line 9—9 in FIG. 8.
Figure 10:
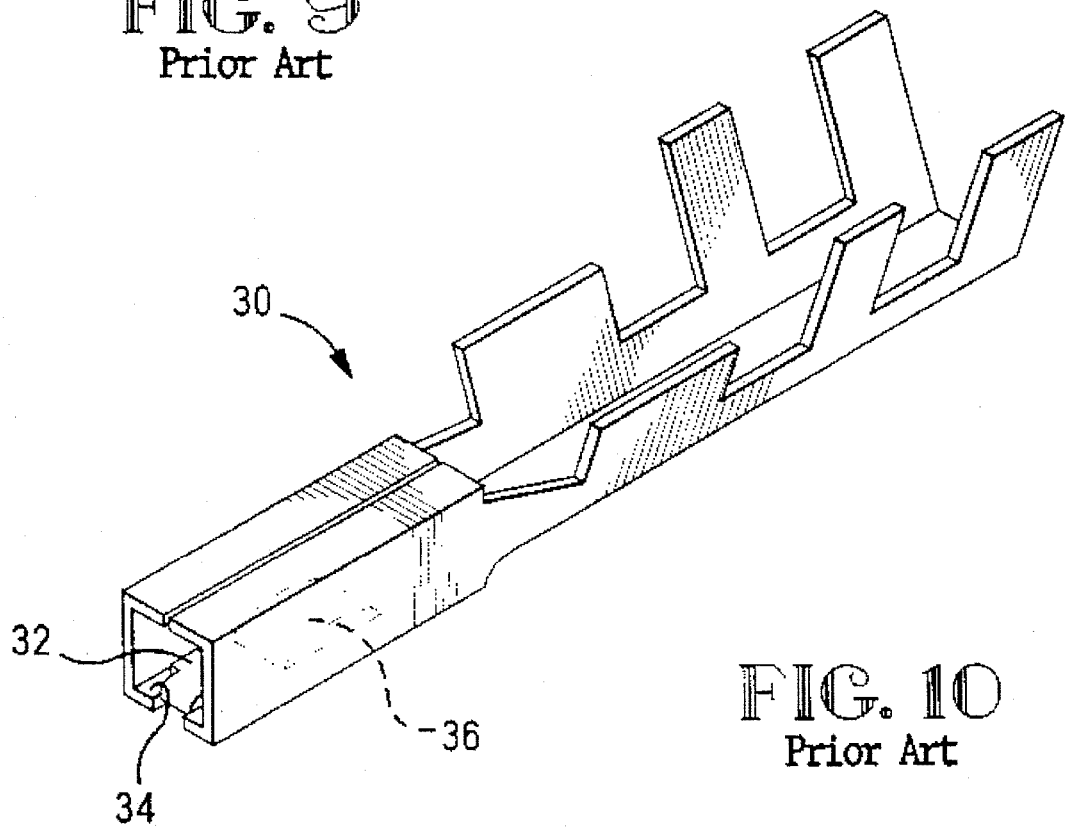
FIG. 10 Prior Art
FIG. 10 is a perspective view of another conventional female contact.
Figure 11:
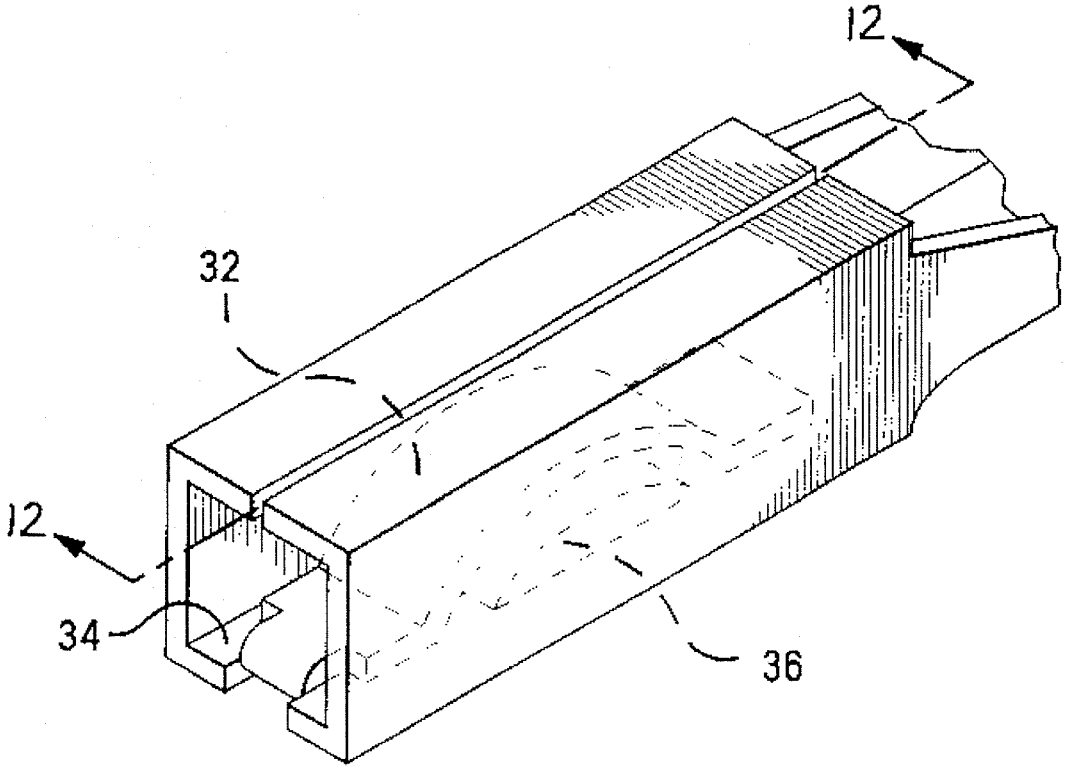
FIG. 11 Prior Art
FIG. 11 is a part perspective view of FIG. 10.
Figure 12:
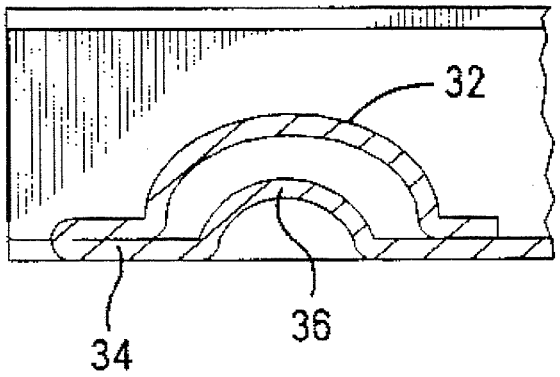
FIG. 12 Prior Art
FIG. 12 is a cross-sectional view taken along line 12—12 in FIG. 11.

The female contact 40 (FIGS. 1–7) is made by bending a blank stamped to a predetermined shape from brass or other copper alloy sheet material that comprises a male contact receiving section 42 intended for receiving a male contact (not shown in the drawing) and a wire crimping section 44 intended for connecting to an electric wire by crimping. As seen in FIG. 2, the male contact receiving section 42 is generally a box shaped portion that comprises an upper wall 46, side walls 48, 50 and a bottom wall 52, all of which extend in the direction of connection with a male contact. In the upper wall 46, two inwardly-directed bosses **46*a* are formed. As shown in FIG. 6, inside the male contact receiving section 42, there is a spring-loaded contacting section 60 which is formed by bending it backwards starting at bend 54 and then by bending again to extend forwardly at bend 56. The spring-loaded contacting section 60 is formed so that it is spring-loaded and has a dimple 56*a* located on a slanted section 58 that is between bends 54 and 56. A male contact (not shown) is inserted between the spring-loaded section 60 and the upper wall 46. The contacting pressure is increased due to the fact that the engagement of the spring-loaded section 60** with a male contact is between the bosses 46*a* and the dimple 56*a*. A stopper 62 is located underneath and near the center of the slanted section 58 of the spring-loaded contacting section 60, which is formed by cutting and bending upward a portion of the bottom wall 52. This stopper 62 prevents the slanted section 58 from undergoing deformation even if a strong force is applied to it by a tool or some other object.

Figure 3:
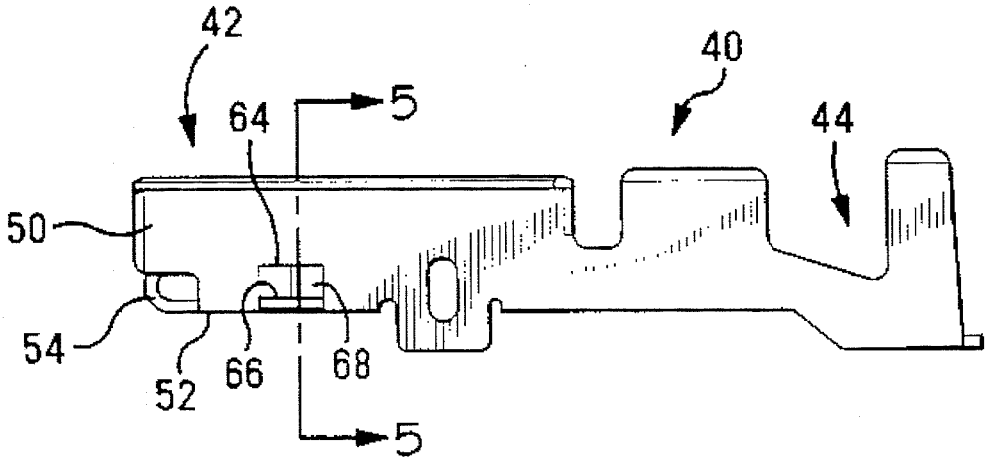
FIG. 3 is a side view of the female contact in FIG. 1.
Figure 4:
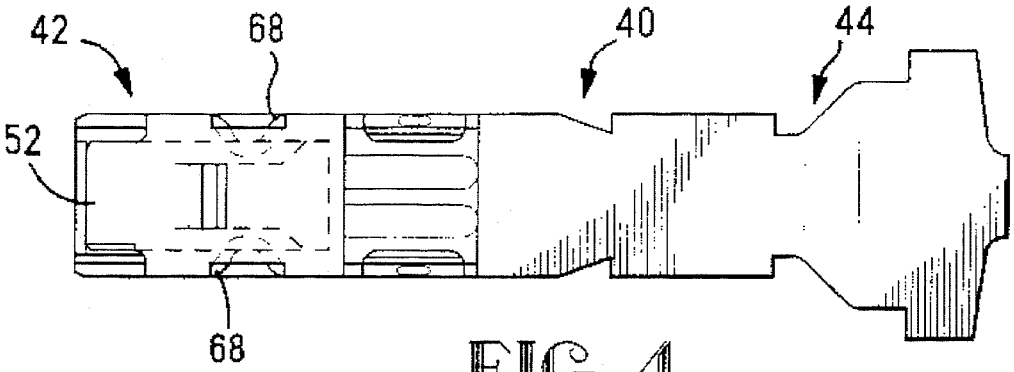
FIG. 4 is a bottom view of the female contact in FIG. 1.
Figure 5:
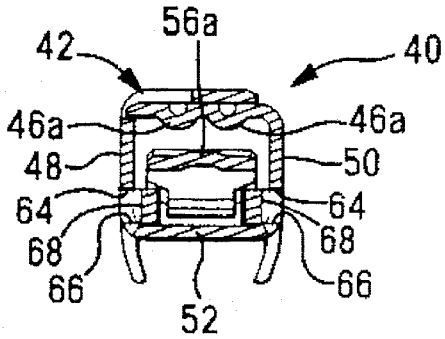
FIG. 5 is a cross-sectional view taken along line 5—5 in FIG. 3

As seen in FIG. 3, there are two generally parallel cuts 64, 66 extending generally parallel to the bottom wall 52 in the side walls 48 and 50. The portions of the side walls between these cuts 64, 66 form inwardly-directed protrusions 68 situated between the bottom wall 52 and the slanted section 58 of the spring-loaded contacting section 60 (FIGS. 4–7). The cuts 64, 66 may be made as slits having practically no width or as slots of a certain width. Since these protrusions 68 are V-shaped with both ends fixed at the side wall, they can withstand strong stress forces. In addition, because their surfaces are formed by cutting of the side wall, it is easier to ensure the uniformity and precision of their dimensions.

When a male contact (not shown), guided by the slanted section 58, is inserted in the male contact receiving section 42, it presses the spring-loaded contacting section 60 downward, and since this contacting section 60 is spring-loaded, the male contact becomes clamped between it and the upper wall 46. Now, a case is examined when the male contact is inserted so that it bends the spring-loaded contacting section 60 downward. In such a case, there is a possibility that the stress in the spring-loaded contacting section 60 will exceed the limits of its elasticity. However, due to the fact that the lower surface of the spring-loaded contacting section 60 in the area of the dimple 56*a* comes in contact with the upper surface of the protrusions 68 disposed under the spring-loaded contacting section 60, no excessive downward bending takes place. Thus, the protrusions 68 sufficiently perform their anti-overstress function.

As follows from the above description, the female contact according to this invention has protrusions 68 or a protrusion 68 made at least in one of the side walls 48,50 located between the bottom wall 52 and the spring-loaded contacting section 60 which are formed by two cuts 64,66 parallel to each other. Since these protrusions 68 are made in a V-shape with both ends fixed at the walls, they are distinguished by the ability to resist higher external stress forces. This makes it possible to avoid deformation in the spring-loaded contacting section 60 even if the male contact is inserted so that it bends the spring-loaded contacting section 60 downward. And since protrusions 68 extend from the side walls, it is possible to form on the bottom wall 52 under the spring-loaded contacting section 60 such structural elements as, for example, ribs, so that the ribs as well as the protrusions 68 themselves, can be used to prevent the female contact from being twisted.

I claim:

1. A female contact (40) having a male contact receiving section (42) for receiving a male contact;

a wire terminating section (44) for connecting a wire to said female contact (40); and a spring-loaded contacting section (60) that extends from a bottom wall (52) of said female contact (40);

characterized by the fact that a protrusion (68) extends inwardly from spaced longitudinal locations along a side wall (48,50) of the male contact receiving section (42) so that the spring-loaded contacting section (60) engages said protrusion (68) when the spring-loaded contacting section (60) has a force pushing it downward towards said bottom wall (52), thereby providing a surface that is attached to more than one location on the side wall (48,50) which can better withstand a downward force and prevent deformation of said spring-loaded contacting section(60).

2. A female contact (40) as in claim 1, wherein said male contact receiving section (42) is box shaped.

3. A female contact (40) as in claim 1, wherein at least one boss (46*a*) is formed on said top wall (46) of said male contact receiving section (42) that will engage the male contact when it is inserted and forced against the top wall (46) by said spring-loaded contacting section (60).

4. A female contact (40) as in claim 1, wherein said spring-loaded contacting section (60) comprises a first section (58) extending from the bottom wall (52) towards the wire terminating section (44) which is connected to the bottom wall (52) by a first bend (54) and a second section (56) that is connected to the first section (58) by a second bend (56) opposite said first bend (54), whereby said second section (56) extends underneath the first section (58) from said second bend (56) towards said first bend (54).

5. A female contact (40) as in claim 1, wherein a dimple (56*a*) is located on the spring-loaded contacting section (60) that engages the male contact.

6. A female contact (40) as in claim 1, wherein a stopper (62) extends upwardly from the bottom wall (52) underneath and near the center of said spring-loaded contacting section (60) that prevents deformation along said spring-loaded contacting section (60).

7. A female contact (40) as in claim 1, wherein said protrusion (68) is V-shaped with both ends fixed at the side wall (48,50).

8. A female contact (40) as in claim 1, wherein each side wall (48,50) of the male contact receiving section (42) has said protrusion (68).

* * * * *